US007255588B2

(12) United States Patent
Wilder

(10) Patent No.: US 7,255,588 B2
(45) Date of Patent: Aug. 14, 2007

(54) POWER CORD HANGER OUTLET FACEPLATE

(76) Inventor: Jackson R Wilder, 3037 Bonita Dr. SE., Grand Rapids, MI (US) 49508

( * ) Notice: Subject to any disclaimer, the term of this patent is extended or adjusted under 35 U.S.C. 154(b) by 0 days.

(21) Appl. No.: 11/272,628

(22) Filed: Nov. 14, 2005

(65) Prior Publication Data

US 2007/0111586 A1 May 17, 2007

(51) Int. Cl.
*H01R 13/62* (2006.01)

(52) U.S. Cl. ..... 439/373; 439/501

(58) Field of Classification Search ..... 439/373, 439/501, 536, 4; 191/12.2 R; 174/66, 67; 220/241, 242; D13/156, 177
See application file for complete search history.

(56) References Cited

U.S. PATENT DOCUMENTS

| | | | | |
|---|---|---|---|---|
| 2,231,001 A | | 2/1941 | Engstrom | 174/135 |
| 2,438,143 A | | 3/1948 | Brown | 173/361 |
| 3,013,105 A | | 12/1961 | Craig | 174/67 |
| 3,042,739 A | | 7/1962 | Craig | 174/66 |
| 3,113,996 A | * | 12/1963 | Sanford | 174/67 |
| 3,257,497 A | | 6/1966 | Chase | 174/66 |
| 3,689,868 A | | 9/1972 | Snyder | 339/119 |
| D275,175 S | | 8/1984 | Rolli, Jr. | D8/356 |
| 4,566,666 A | | 1/1986 | Meska et al. | 248/558 |
| 4,921,444 A | | 5/1990 | Cama | 439/528 |
| D323,285 S | | 1/1992 | Thomson | D8/372 |
| 5,547,390 A | | 8/1996 | Laherty | 439/373 |
| 6,130,384 A | | 10/2000 | Esteves et al. | 174/66 |
| 6,803,522 B2 | * | 10/2004 | Skakun | 174/66 |
| 2004/0035972 A1 | * | 2/2004 | Glass | 242/388.6 |

* cited by examiner

*Primary Examiner*—Tho D. Ta
*Assistant Examiner*—Vanessa Girardi
(74) *Attorney, Agent, or Firm*—Van Dyke, Gardner, Linn & Burkhart, LLP

(57) ABSTRACT

An outlet faceplate includes a body dimensioned to cover an outlet and at least one member integral at an upper portion of the body. The body includes an opening for allowing access to the outlet and an outwardly facing planar surface. The member extends generally forward and then upward from the body to provide a space above the body and behind the member wherein the space receives an excess cord.

16 Claims, 7 Drawing Sheets

POWER CORD HANGER OUTLET FACEPLATE

FIELD OF THE INVENTION

This invention relates generally to a faceplate for an outlet, such as an electrical outlet and associated hardware, and, more specifically, to an improved faceplate capable of receiving and storing excess cord, such as a power cord.

BACKGROUND OF THE INVENTION

During normal usage of electrical tools, appliances, or other electrical implements, electrical power cords supplying electricity or cable cords, such as phone cable cords, television cable cords, antenna cable cords, or computer cable cords, supplying signals may often lie exposed on the floor of a room creating both a hazardous and unsightly condition. As a result, the cord may become inadvertently or accidentally unplugged or disconnected from its respective outlet when the cord is pulled or tripped over. Accordingly, there is a need in the art for a way to store excess cord.

SUMMARY OF THE INVENTION

Accordingly, the present invention provides a faceplate that is adapted to store excess cord.

In one form of the invention a faceplate includes at least one projecting member integral at the upper portion of the faceplate. The faceplate is adapted for mounting over an outlet, while still allowing access to the outlet, and permits excess cord to be wrapped or wound around the member. The excess cord is held in place with the assistance of friction and/or the weight of the excess cord. Thus, the excess cord is stored by the member and further prevents the cord from being inadvertently unplugged from the outlet, while still allowing access to the outlet.

In another form of the present invention, an electrical outlet faceplate is provided that includes a body dimensioned to cover an electrical outlet and at least one member integrally formed at an upper portion of the body. The body includes at least one opening for receiving an electrical outlet receptacle of the electrical outlet. The member extends generally forward and then upward from the body to provide a space behind the member and above the body. The space is sized to receive one or more loops of excess power cord of an electrical plug.

In another form of the present invention, a faceplate is provided that includes a body dimensioned to cover an outlet with a pair of parallel and generally flat members integral at an upper portion of the body. The body includes at least one opening for providing access to the outlet. Each of the flat members includes a first portion and a second portion. The first portion extends generally forward from the body. The second portion extends generally upward from the first portion such that the second portion is substantially parallel to a forward facing plane of the body to provide a space behind the members when the faceplate is mounted over the outlet. This space can then receive windings of excess cord.

In yet another embodiment of the present invention, an electrical outlet faceplate attachment is provided. The outlet faceplate attachment includes a planar body with a planar surface, which is dimensioned to mount over an electrical outlet or over an electrical outlet faceplate and includes at least one member, which is integrally formed at an upper portion of the body. The body includes an opening for accommodating receptacles of the electrical outlet and the openings of the faceplate. The member extends generally forward and then upward from the body and, further, is generally parallel to the planar surface of the body to provide a space behind the member, which can accommodate an excess power cord.

Therefore, the present invention provides an electrical outlet faceplate or faceplate attachment that makes it easy to receive and store excess power cord of an electrical plug.

These and other objects, advantages, purposes and features of the present invention will become apparent upon review of the following specification in conjunction with the drawings.

DESCRIPTION OF THE PREFERRED EMBODIMENTS

Figure 1:
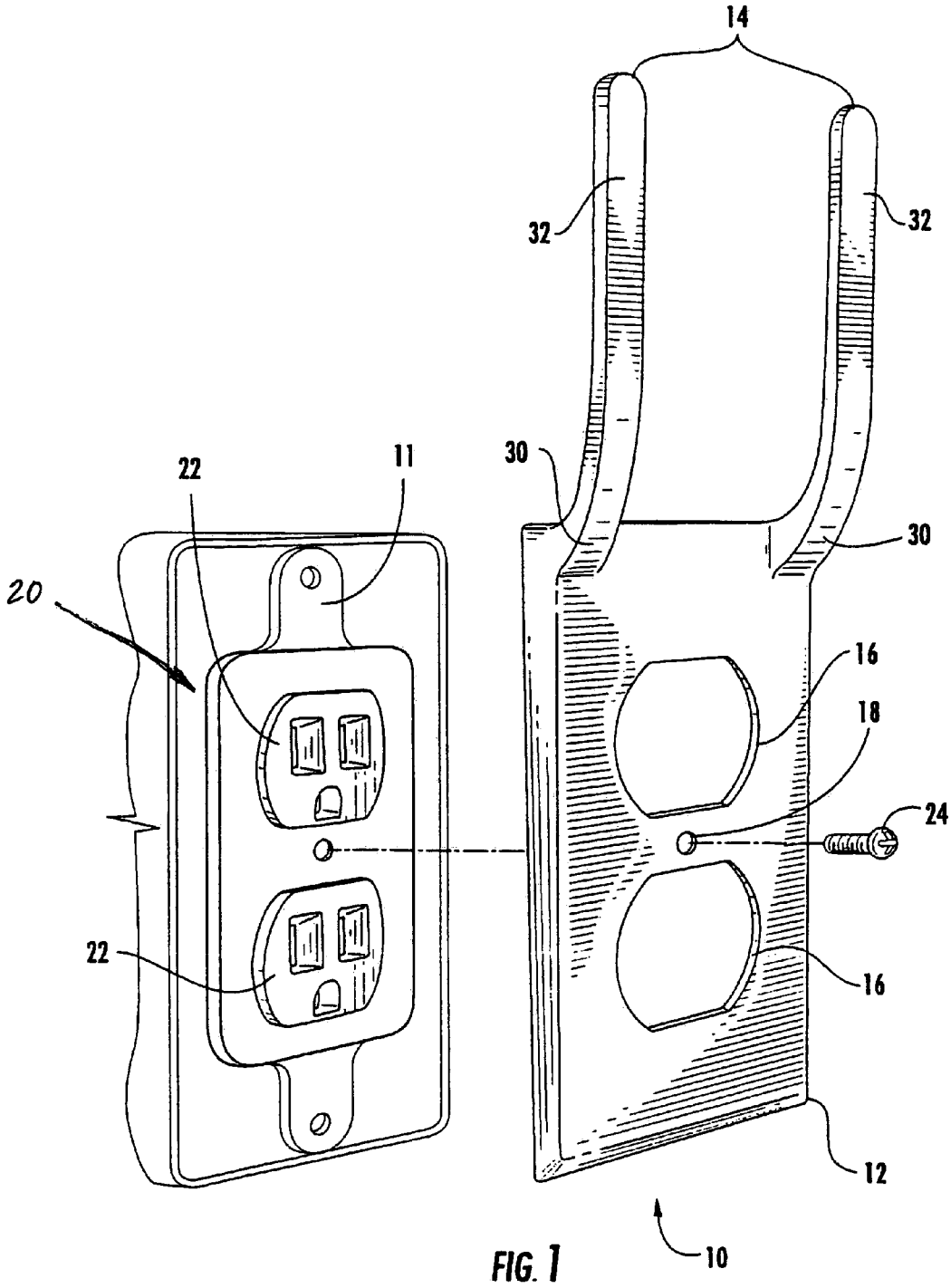
FIG. 1 is an exploded perspective view of an outlet faceplate of the present invention and an electrical outlet.

Referring now to the drawings and the illustrative embodiments depicted therein, the numeral 10 generally designates a faceplate of the present invention. Faceplate 10 is adapted for mounting over an outlet and, further, configured for storing excess cord at the faceplate. In the illustrated embodiment, faceplate 10 comprises an electrical outlet faceplate 10 that is adapted for mounting over an electrical outlet with one or more receptacles. However, it should be appreciated that faceplate 10 may be configured and arranged for mounting over other outlets, including cable outlets, phone outlets, or computer connection outlets and for allowing cable cords, phone cords or computer cable cords to be stored at the faceplate. But for ease of description the following description will be made in reference to an electrical outlet faceplate or attachment, described below.

As best seen in FIG. 1, faceplate 10 includes a body 12 for mounting over an electrical outlet 20 and includes one or more openings through which the outlet receptacles 22 of the outlet project. As noted, faceplate 10 is adapted to store excess power cord of an electrical plug and, further, store the excess cord in a manner that does not interfere with the use of the outlet.

Referring again to FIG. 1, body 12 includes a pair of projecting members 14 (FIG. 1) that are configured to allow an excess power cord to be wrapped around and retained on the members. Members 14 are integrally formed at an upper portion of body 12 so that members 14 and body 12 are formed as unitary member, which simplifies the installation and manufacture of the faceplate of the present invention. The integral formation may be achieved through various methods, including molding or welding or adhesive bonding of the members to the body. In the illustrated embodiment, faceplate 10 includes two projecting members 14. However, it should be noted that a single projecting member or more than two projecting members may be used while keeping within the scope and spirit of the present invention.

Body 12 further includes at least one opening for receiving outlet receptacles 22 of electrical outlet 20 therethrough, and an aperture 18, for receiving mounting hardware, such as a screw 24. In the illustrative embodiment of FIGS. 1-9, faceplate 10 is shown with two openings 16, but faceplate 10 may include a single opening or more than two openings depending on the type of electrical outlet 20, while keeping within the scope of the present invention. It should be noted, the present invention contemplates application to all different types or configurations or layouts or sizes of electrical outlets and may be integrated with a plurality of types or sizes of electrical outlet faceplates.

Figure 2:
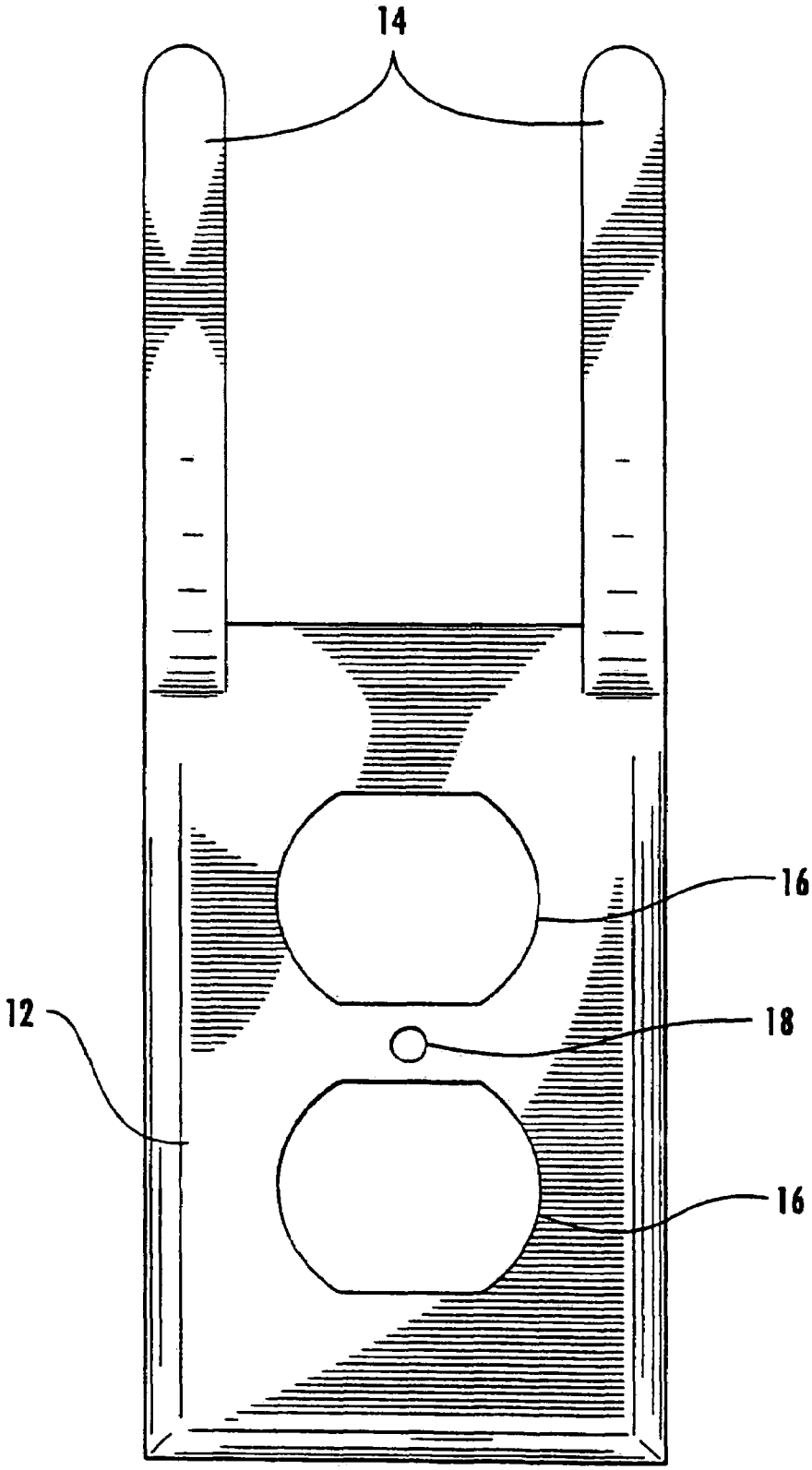
FIG. 2 is a front elevation of the other faceplate of FIG. 1.
Figure 3:
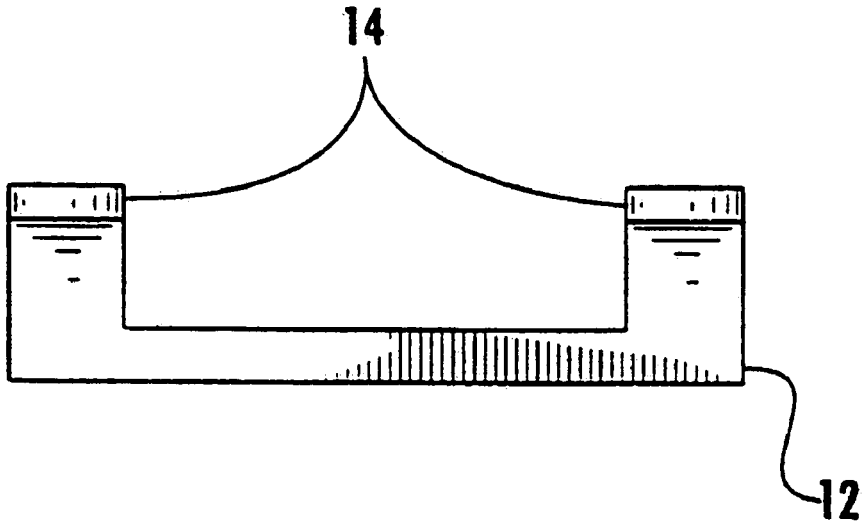
FIG. 3 is a top view of the faceplate of FIG. 1.
Figure 4:
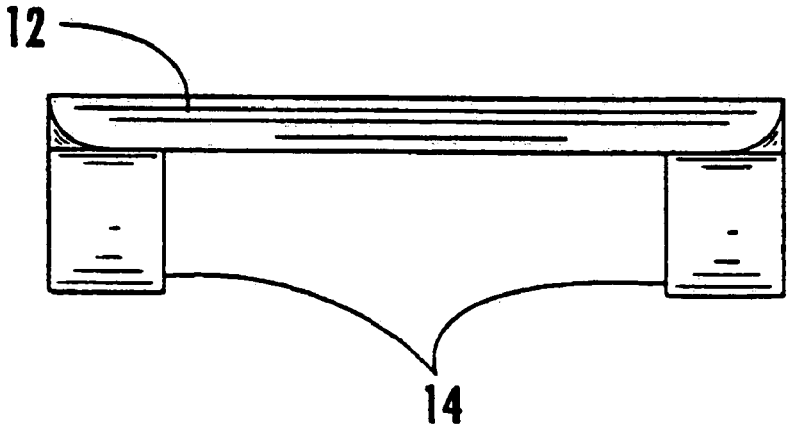
FIG. 4 is a bottom view of the faceplate of FIG. 1.
Figure 5:
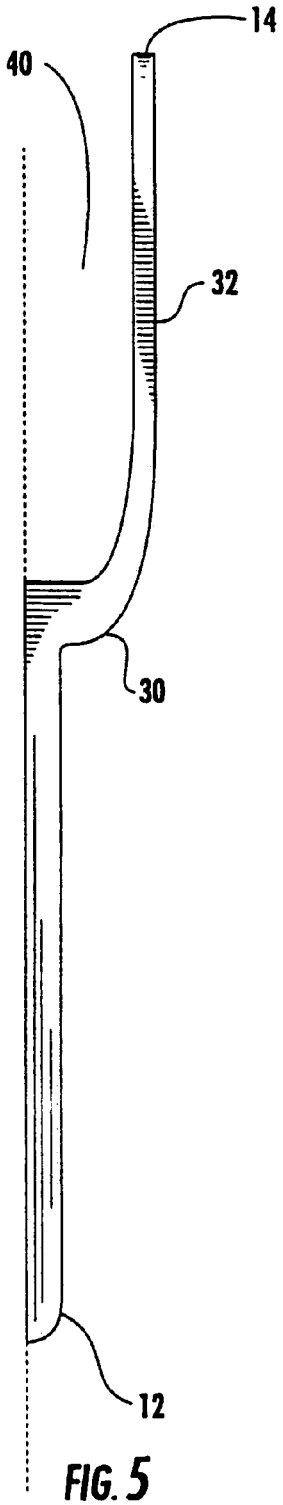
FIG. 5 is a side view of the faceplate of FIG. 1.
Figure 6:
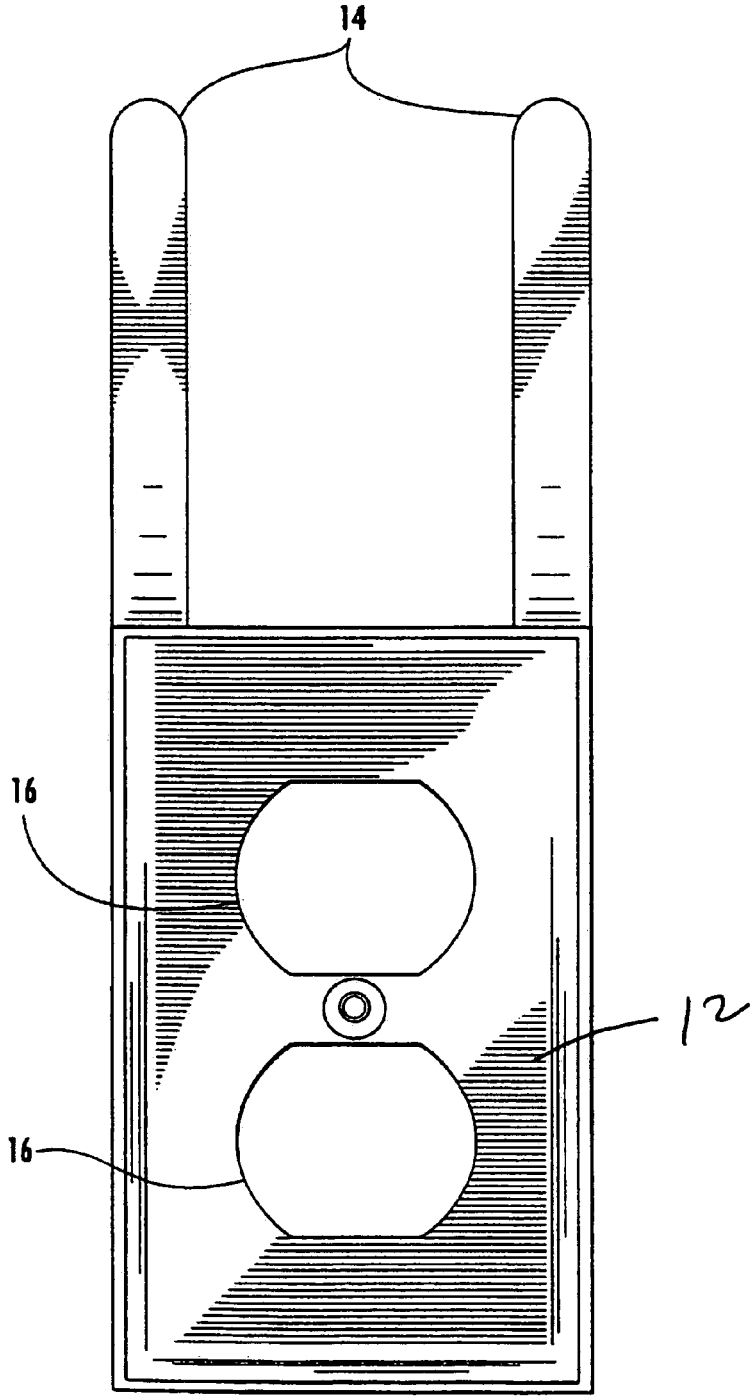
FIG. 6 is a back view of the faceplate of FIG. 1.
Figure 7:
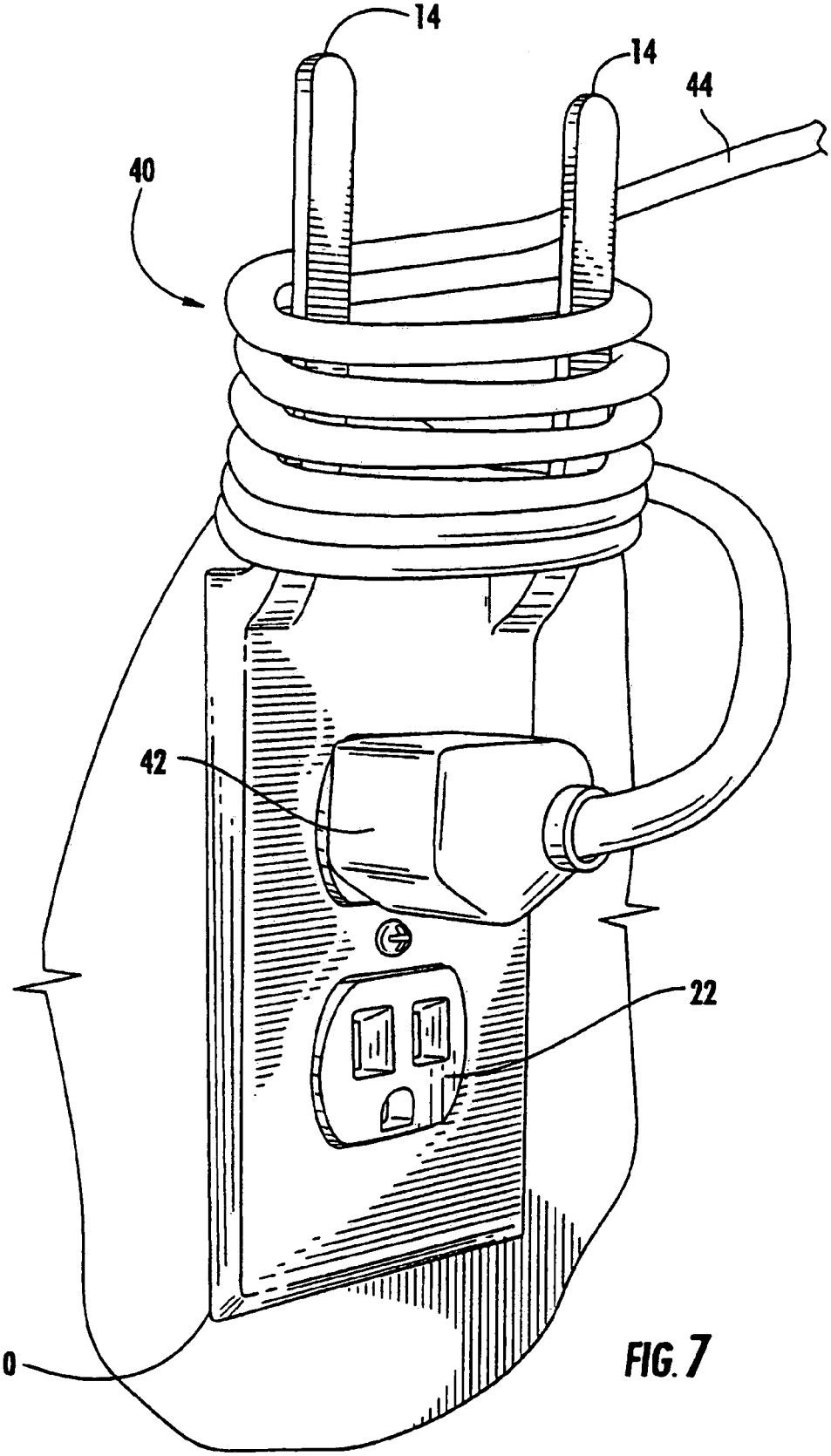
FIG. 7 is a perspective view of the faceplate of FIG. 1 mounted to an outlet with the excess power cord of an electrical plug wrapped around the projecting members of the faceplate.

As noted above, members 14 are adapted to store excess power cord of an electrical plug at faceplate 10. Referring to FIGS. 1, 2 and 5 members 14 include a first portion 30 that extends generally forward and outward from body 12 and a second portion 32 extending generally upward from the first portion. Each of the first portions 30 preferably includes an arcuate shape profile, when viewed from the side. The arcuate shape of first portions 30 direct or guide the excess cord inwardly toward the mounting surface on which faceplate 10 is mounted. Second portions 32 extend from first portions 30 upward and generally parallel to an outwardly facing surface or plane of faceplate 10 to create space or spaces 40 behind members 14 for receiving a plurality of loops of the excess power cord 44.

In the illustrated embodiment a standard two receptacle electrical outlet is provided, thus space 40 may potentially accommodate two excess power cords 44. Further, space 40 may be configured to hold and store more than two excess power cords dependent upon the requirements of the application and/or number of outlet receptacles present.

As noted the arcuate shape of first portion 30 assists in receiving and retaining excess power cord 44 while keeping the excess cord up and away from body 12 to provide clear and unobstructed access to outlet receptacles 22. It should be understood that the size of both the length and width of the members may be varied. For example, the total length of first portion 30 may be approximately 1", but alternatively may be any length required for the specific application or dependent upon the gauge and/or length of the excess power cord 44. For example, second portion 32 may extend from first portion 30 upward at a length of approximately 3", but the second portion may vary in length dependent upon the application or gauge or length of excess power cord 44. Second portion 32 is preferably projecting in an upward direction generally parallel to the plane of the outwardly facing side of faceplate 10 to utilize gravity for assistance in receiving and storing excess power cord into space 40. As would be understood, members 14 receive excess power cord 44 in a stacking fashion or manner, which utilizes the weight of the stacked excess power cord to hold the cord down and return the cord in space 40.

Alternatively, each member 14 may individually receive a separate excess power cord 44 on each member. For example, the left member may receive an excess power cord from the top outlet receptacle, while the right member receives excess power cord from the lower outlet receptacle.

In the illustrated, members 14 have a generally square or rectangular generally uniform cross sectional profile running the length of respective members 14. It should be noted that the profile shape of members 14 may vary according to the application required or specific preferences during the manufacturing process. First portion 30 optionally includes a varying profile thickness to provide for the additional strength and support required at the base of member 14 to accommodate the weight of excess power cord 44 as the excess cord is received. Second portion 32 may include a constant and uniform profile thickness throughout its entire length. In addition, the top of member 14 (at the top of second portion 32) may be generally rounded, as viewed from the top to minimize or eliminate any catch points so that the power cord 44 can be easily slipped over the ends of the members. Further, with rounded ends, the risk of injury from contact with sharp edges is eliminated to the user. In addition, members 14 may have a circular or substantially round profile throughout the entire length of the member. Alternatively, the top of second portion 32 may be squared or domed or configured with another shape, while keeping with the scope of the present invention.

Faceplate 10 preferably comprises a plate with a planar front or outwardly facing surface, which is formed from a rigid material, such as polymeric material, including plastic, and is molded with members 14 integral to body 20. Alternatively, faceplate 10 may comprise other rigid materials, such as metal or wood, or may be formed from a composite material, or the like while keeping with the spirit and scope of the present invention. The material and dimensions of faceplate 10 is such that faceplate 10 is preferably sufficiently rigid to accommodate the weight of at least one excess outlet cord 44.

In the illustrated embodiment, faceplate 10 is generally rectangular in shape with an upper edge, a lower edge, and opposed side edges, which extend between the upper and lower edges. As best seen in FIG. 2, members 14 are spaced apart and extend from the upper portion of body 12 at its upper edge and are located at the opposed side edges.

In operation, a user attaches faceplate 10 over electrical outlet 20 using machine screw 24 via screw hole 18. The user may then plug an electrical plug 42 into electrical outlet receptacle 22. Thereafter, the user may wrap or wind excess power cord 44 around members 14. As noted, members 14 receive excess power cord 44 in space 40 in a stacking fashion to utilize the weight of the excess power cord to retain the cord in spaces 40. Members 14 also allow for the quick removal of stored or wound excess power cord 44. Thus, excess power cord 44 is neatly stored to provide clear access to outlet receptacles 22 while preventing the plug from being inadvertently pulled from the outlet.

Referring to FIG. 5, first portion 30 of member 14 may project forward from body 12 in a range of about 80 to 115 degrees relative to the outwardly facing surface of body 12. Second portion 32 may extend generally upward and generally parallel to the outwardly facing surface or plane of body 12. For example, first portion 30 may extend outwardly at right angles—at about 90 degrees—relative to the outwardly facing surface of body 12. Second portion 32 then extends upward at an angle of about 90 degrees relative to first portion 30, perfectly with a relatively smooth or curved transition.

To provide a gripping surface, members 14 may include a coating or cover made of a high friction material, such as rubber, that may assist in holding or retaining the excess power cord 44 during storage. Optionally, members 14 may be molded to include indentations, detents, ridges, ribs, or the like for providing better retention of excess power cord 44 during storage.

Figure 8:
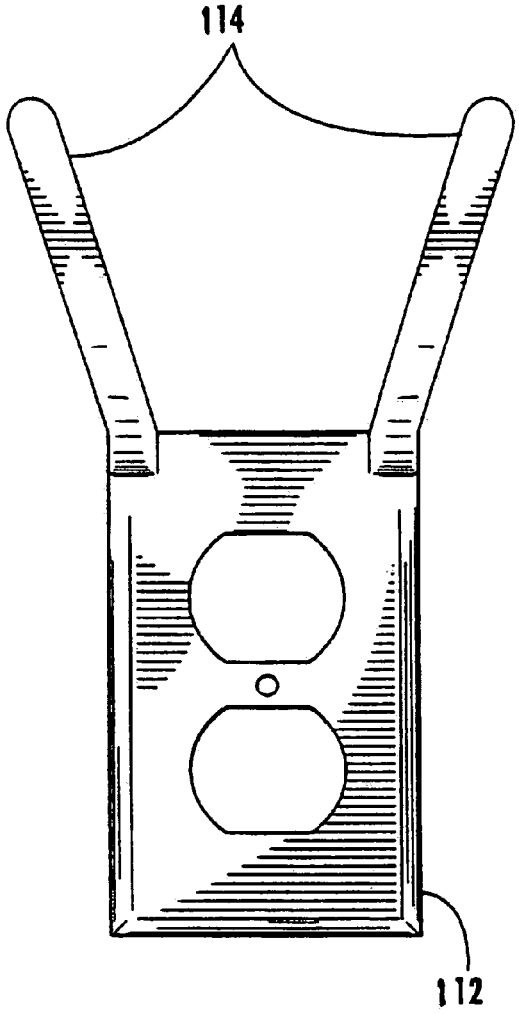
FIG. 8 is a front elevation view of another embodiment of the faceplate of the present invention.

Referring to FIG. 8, in another alternative embodiment of the present invention, members 114 may project at an angle outward or inward relative to the parallel opposed side edges of body 112 while the members are still parallel to the outwardly facing surface of body 112 to provide the space for storing the excess power cord. Outward angled members 114 may therefore be able to receive and secure a longer power cord.

Figure 9:
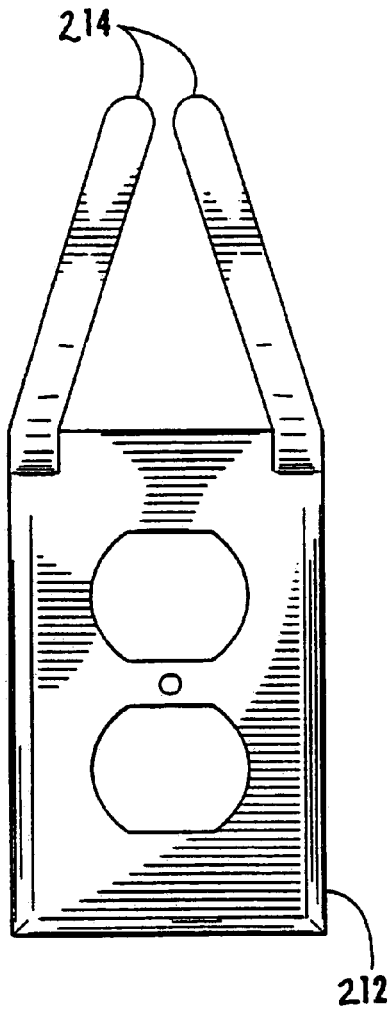
FIG. 9 is a front elevation view of another embodiment of the faceplate of the present invention.

Referring to FIG. 9, in another embodiment of the faceplate, the members 214 may be angled inwardly toward each other.

Figure 10:
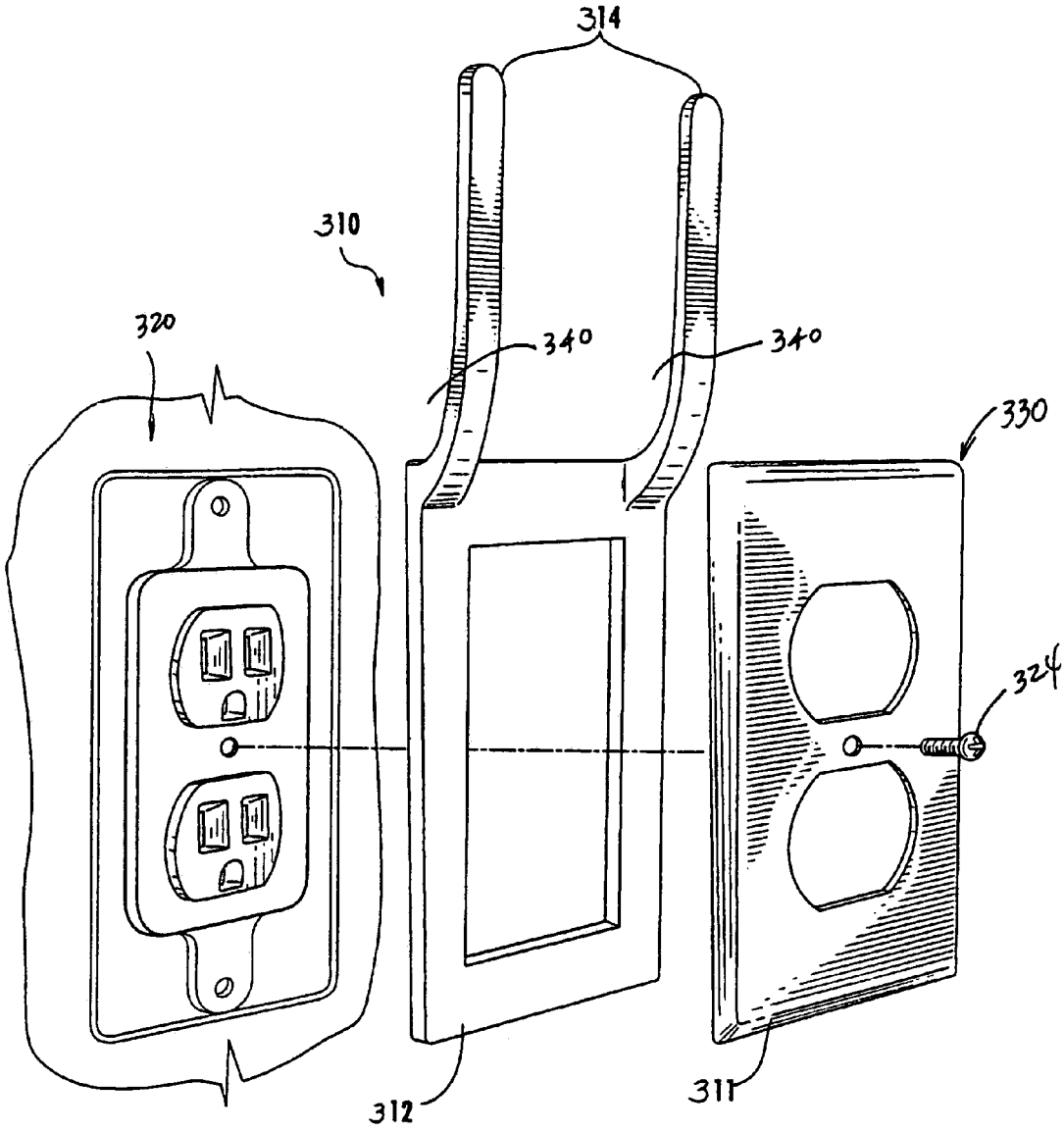
FIG. 10 is a side perspective exploded view of a faceplate attachment and faceplate of the present invention.

In yet another embodiment of the present invention an outlet faceplate attachment 310 is provided (FIG. 10). Attachment 310 includes a body 312 and members 314 integrally formed with body 312. Body 312 has a plate-like structure with at least one opening to accommodate outlet receptacles and align with openings in a standard faceplate 330. Attachment 310 is capable of being secured or attached behind standard outlet faceplate 330 and secured to the outlet 320 with fastener 324 with a press or friction fit, as understood from the illustrated embodiment in FIG. 10. In this configuration, body 312 includes a very thin or narrow side profile such that when attachment 310 is placed behind outlet faceplate 330, the attachment will not greatly increase the offset of the outlet faceplate from electrical outlet 320. Alternatively, attachment 310 may be secured to the front of standard outlet faceplate 330 with some form of adhesive or the like or fasteners. Attachment 310 provides a space 340 for receiving excessive electrical power cord in a similar manner and fashion as the previous embodiments; therefore, reference is made there to for further details of members 314 and body 312.

Accordingly, the present invention provides an electrical outlet faceplate that receives and stores excess power cord while providing access to the electrical outlet receptacles and preventing inadvertent pulling of the plug from the electrical outlet. Further, the present invention provides an easy way to store excess power cord. While several forms of the invention have been shown and described, it should be understood that further changes can be made. For example, as noted, the faceplate may be configured to mount over other outlets, such as phone jack outlets, cable outlets, computer jack outlets or the like with the excess cord, such as a phone cord or cable cord, including a computer cable cord, may be stored at the faceplate in a similar manner described above.

Changes and modification to this specifically described embodiment may be carried out without departing from the principles of the present invention, which is intended to be limited only by the scope of the appended claims, as interpreted according to the principles of patent law.

I claim:

1. An outlet faceplate comprising:

a body dimensioned to cover an outlet, said body including an opening for allowing access to the outlet and having an outwardly facing planar surface and an upper edge; and a pair of members, said members spaced apart, and each of said members extending upwardly from the upper edge of said body, and each of said members comprising:

a first portion extending generally forward from said upper edge of said body; and a second portion extending generally upward from said first portion, wherein said second portions are substantially parallel to said planar surface of said body and wherein spaces are formed above said body and behind said second portions wherein a cord may be wrapped around said second portions in loops, with the loops vertically stacking on said second portions.

2. The faceplate of claim 1 wherein said body further includes:

an aperture operable for receiving a fastener for attaching said faceplate to the outlet.

3. The faceplate of claim 1, wherein said faceplate comprises a polymeric material or a metallic material.

4. The faceplate of claim 1, wherein each of said members includes a generally flat rectangular profile or a circular profile.

5. The faceplate of claim 1, wherein each of said first portions comprises a generally arcuate portion, and each of said second portions comprising a generally linear portion.

6. The faceplate of claim 1, wherein said first portions extend from said body substantially perpendicular to said planar surface, and said second portion extends substantially perpendicular from said first portions and substantially parallel to said planar surface.

7. An electrical outlet faceplate comprising:

a body dimensioned to cover an electrical outlet, said body including a pair of openings for receiving a pair of electrical outlet receptacles of said electrical outlet and having an outwardly facing planar surface;

only one pair of generally parallel members integral at an upper edge of said body, said members each including a first portion and a second portion, said first portions extending generally outward from said upper edge of said body, said second portions extending generally upward from their respective first portions such that said second portions are generally parallel to said outwardly facing planar surface of said body to provide spaces above said body and behind said members; and wherein said spaces are of sufficient size to receive an excess power cord of an electrical plug.

8. The face plate according to claim 7, wherein each of said members has generally rectangular cross-section.

9. The faceplate according to claim 7, wherein each of said members includes a distal end, each of said distal ends being rounded.

10. The faceplate according to claim 7, wherein said body comprises a rectangular plate having said upper edge, a lower edge, and opposite side edges extending between said upper and lower edges.

11. The faceplate according to claim 10, wherein said members are located at said opposed side edges.

12. An electrical outlet faceplate attachment comprising:

a planar body dimensioned to attach to an electrical outlet, said planar body having a planar face and including at least one opening for accommodating at least one receptacle of the electrical outlet;

an electrical outlet faceplate for mounting to the outlet either over said body or under said body; and a pair of members, said members being spaced apart, each of said members extending upwardly from an upper edge of said body, each of said members comprising:

a first portion extending generally forward from said upper edge of said body; and a second portion extending generally upward from said first portion, wherein said second portions are substantially parallel to said planar face of said body and wherein spaces are formed above said body and above said faceplate and behind said second portions wherein a cord may be wrapped around said second portions in loops, with the loops vertically stacking on said second portions.

13. The attachment of claim 12, wherein said faceplate has a rectangular perimeter, said body including a perimeter dimensioned to have approximately the same perimeter as said faceplate.

14. The attachment of claim 12, wherein said attachment is mounted to said outlet or said faceplate by an adhesive.

15. The attachment of claim 12, wherein said body includes only one pair of said members at said upper edge.

16. The attachment of claim 15, wherein said members are generally parallel to each other and extend upwardly from said upper portion of said body.

* * * * *